US009622628B2

(12) United States Patent
Zawrotniak et al.

(10) Patent No.: US 9,622,628 B2
(45) Date of Patent: Apr. 18, 2017

(54) DISPOSABLE FOLDING POTTY

(71) Applicants: Bozena Zawrotniak, Kraków (PL); Janusz Pancerz, Kraków (PL)

(72) Inventors: Bozena Zawrotniak, Kraków (PL); Janusz Pancerz, Kraków (PL)

( * ) Notice: Subject to any disclaimer, the term of this patent is extended or adjusted under 35 U.S.C. 154(b) by 0 days.

(21) Appl. No.: 14/457,737

(22) Filed: Aug. 12, 2014

(65) Prior Publication Data

US 2016/0045085 A1 Feb. 18, 2016

Related U.S. Application Data

(63) Continuation-in-part of application No. PCT/PL2013/000014, filed on Feb. 7, 2013.

(30) Foreign Application Priority Data

Feb. 13, 2012 (PL) ..... 398090

(51) Int. Cl.
*A47K 11/06* (2006.01)

(52) U.S. Cl.
CPC ..... *A47K 11/06* (2013.01)

(58) Field of Classification Search
CPC ..... A47K 11/06
USPC ..... 4/484
See application file for complete search history.

(56) References Cited

U.S. PATENT DOCUMENTS 1,663,966 A 7/1927 Ament et al.
2,849,726 A * 9/1958 Vay ..... A47K 11/02 229/112
5,040,249 A * 8/1991 Diaz ..... A47C 5/005 4/460
5,732,418 A * 3/1998 Sekitou ..... A47K 11/02 229/125.17
2006/0150312 A1 * 7/2006 Gara ..... A47K 11/00 4/483
2007/0107116 A1 5/2007 Zamberlan
2009/0255046 A1 10/2009 Carter
2009/0265844 A1 10/2009 Gara

FOREIGN PATENT DOCUMENTS

FR 2838949 4/2002
GB 2448945 A 5/2008
JP 2006158891 A 6/2006
WO WO 2006/090178 A1 8/2006
WO WO 2009/027982 A2 5/2009

* cited by examiner

*Primary Examiner* — Christine Skubinna
(74) *Attorney, Agent, or Firm* — Horst M. Kasper

(57) ABSTRACT

The disposable folding potty made of sheet layer material consisting of walls connected by side edges defining the inner space of the potty in the form of an accordion and having folds in the bottom part, and including a bag with an absorbent pad between its seat and its walls, where there are two more edges folding outwards (22) than inwards (22'), and the walls (21) are connected with the seat of the potty (14) by glued rectangular wings (15) which are placed on the end of the vertical walls (21), folded in the same direction. The potty has side rubber bands (101) hooked onto the base of the potty and the seat which help with the opening of the potty and its stabilization once opened. The potty also has a rubber band (18) and foil handles (19) for closing and transportation.

5 Claims, 8 Drawing Sheets

DISPOSABLE FOLDING POTTY

CROSS-REFERENCE TO RELATED APPLICATIONS

The present application is a continuation-in-part application of PCT Application No. PCT/PL2013/000014.

BACKGROUND OF THE INVENTION (1) Field of the Invention

The present invention relates to a disposable folding potty designed especially for children aged 1.5 through 6.

The invention is aimed to facilitate passing and short term storage of fecal matter in situations when a toilet is not available, i.e. in some public places, playgrounds or when traveling using a public transportation. There are other known disposable potties used for the same purpose.

(2) Description of Related Art Including Information Disclosed Under 37 CFR 1.97 and 1.98.

The patent application(s) US2009265844 (and WO2004037062) describe(s) a known folding toilet made of sheet layer material made of side walls connected by side edges and an inner space formed by a toilet seat located on the upper edge of the side walls and folds for folding the toilet. The toilet comprises of two opposite holding side walls having upper edges, to which there are attached two edges of the annular seat surface along the respective folding lines (folds), and supporting the side walls, on whose upper edge the rest of seat surface is distributed.

Unfolding of the toilet presupposes the use of both hands and requires at least a few moves. This method does not provide a mechanism which prevents the fecal matter from falling out.

There also exists a British invention described in the application number PCT/GB2008/002132 (GB2448945B) with a fairly complex folding method. The size of the potty before and after unfolding is large, and after the use the excrements are stored in an ordinary plastic bag before being disposed of. In addition, it is not entirely a disposable, as only the foil bag is disposed of, and not the whole potty.

There are other known solutions on the market which are also called disposable in the form of a potty having a firm main construction and replaceable pads. In these types of solutions, one is required to carry the entire potty with oneself and fit a special pad in a certain way. After use and disposal of the pad, the potty needs to be carried again.

On Feb. 13, 2012, the applicant also submitted an invention entitled "Disposable Folding Potty" with the Polish Patent and Trademark Office, which obtained the serial number P.398,090. This solution referred to a disposable folding potty made of sheet material comprising of walls connected to each other with side edges and forming the inner space of the potty while taking the form of an accordion and having folds in the bottom part. The walls were connected to the seat with connectors, while the surface of the seat was connected to the walls with point connectors mounted between the triangular wings on the end of each vertical wall and the seat, except for one opposite pair of walls. A bag with absorbent material was mounted between the seat and the walls. The potty had openings in the side walls which were used for threading a cord used for sealing the absorbent pad and a fastening.

BRIEF SUMMARY OF THE INVENTION

The present solution is a supplementary application to the previously submitted solution. It is characterized by further enhancements to simplify the structure which makes the invention cheaper to produce and more practical.

The essence of the invention is the design of a small and handy disposable potty which allows for easy folding and unfolding, and securing the fecal matter after use.

DETAILED DESCRIPTION OF THE INVENTION

The folding potty is made of sheet layer material, such as a pasteboard, composed of side walls connected together by side edges forming an accordion shape and making up the inner space of the potty.

The seat surface is placed on the upper edge of the side walls and unfolds automatically upon unfolding the potty.

The many accordion folds allow for stabilization of the potty after unfolding and increasing its strength.

Conveniently, the potty walls have eight outward folds and eight or six inward folds forming an accordion pattern in the vertical walls.

In the vertical walls triangles were folded on the folding lines at an angle of about 45 degrees, which further stabilizes the potty and leaves room for fecal matter upon closing the potty after use.

One opposite pair of walls does not have inward folds, which allows for easier folding of the potty.

The bottom part of the vertical walls has folded triangles on the fold lines at the 45 degrees angle, which provide additional stabilization for the potty and leaves room for fecal matter when the potty is closed after use.

The surface of the seat is connected to the wall with spot connectors mounted between the triangular wings at the end of each vertical wall and the seat.

The surface of the seat is connected to the vertical wall by gluing rectangular wings which are placed at the end of the end of the vertical walls.

Two of the opposite walls do not have spot connectors, which allows for folding of the potty. Between the two opposite ends of the upper surface of the seat and the base, rubber bands have been placed, designed to support the opening of the potty and its stabilization after opening. To facilitate the sealing and transfer of the used potty, handles, preferably foil ones, have been attached to the widest walls of the potty together with a rubber band for tying (closing) the folded potty.

In the upper part of the walls there are openings, through which a cord with a closing element (puller) is threaded for the purpose of fastening and closing the potty after folding, in order to prevent the fecal matter from leaking out.

The cord is also secured with the fastener before the first use to prevent the potty from opening spontaneously.

The potty is fitted with an inner liner in the form of a foil pouch and absorbent material such as lignin, which absorbs moisture.

The supporting structure of the potty is made of pasteboard, or other material which folds in a similar way to pasteboard and meets the required endurance criteria.

The structure's size before unfolding is much smaller than after unfolding.

The folding method is based on the relevant folding points and surfaces, causing the structure to be rigid and capable of withstanding the load upon unfolding.

Upon unfolding, the top folds form a surface which is the base for the connection to the seat.

An important feature of its design is both rigid construction and, above all, supporting structure which prevents spontaneous unfolding of this element.

The lower folds make it possible for enough space to be left for the bag, also with its content, and they stiffen the structure, and further facilitate unfolding with little force applied.

One favorable effect of the invention is to create a potty, whose unfolding method uses such combination of connections and folds of the material that an initially small potty is converted into a stable structure able to withstand the weight of the child while making it possible for sitting on it, making sudden moves and getting up.

The elements and folds of the design make it easy to refold the potty, while preventing the fecal matter from leaking out. In this form it can be easily transported to a waste container, if one is not available nearby.

The folded potty has a small size, but its design allows for unfolding it with little force applied, without requiring the use of both hands.

The method of folding and unfolding is intuitive and does not require complicated instructions, which demonstrates the simplicity of the invention in the context of common use.

The folding system used, causes the potty to spontaneously unfold when the cord is released, increases the stability of the structure, preventing the potty base from spreading excessively during use and the child's movements to the sides.

The folding system used, causes the potty to spontaneously unfold, and application of two winding rubber bands helps with unfolding the potty and increases its stability, preventing the potty from folding during use and the child's movements to the sides. The folding system produces an open space for the content of the absorbent pad after use and produces a point pressure transfer onto the surface on which the potty is placed. It produces an open space for the content of the absorbent after use and produces a point pressure transfer onto the surface on which the potty is placed. This is significant as the surface may be uneven, with rocks or grass.

The point base provides a better stabilization of the potty than in the case of similar solutions with level base, where a slight unevenness causes the whole structure to be skewed. Upon unfolding, the potty takes a shape that meets the child's anatomical needs.

After unfolding, the potty, and in particular its sitting area, is tailored to the body build of both girls and boys. This prevents the potty from crumpling and the child from taking unnatural postures.

The use of the absorbent and the element closing the potty prevent the fecal matter from leaking out after use and folding of the potty.

The use of the absorbent pad prevents the fecal matter from leaking out after use and folding of the potty.

The absorbent pad is designed to absorb, if possible, fecal matter of varying physiological composition and consistency from the surface of the pad to its inside.

The closing element (puller) makes it simple to fold the potty. An accordion pattern makes it simple to fold the potty.

Another function of this mechanism is to prevent any fluids from leaking out of the potty. An additional function is preventing any fluids from leaking out of the potty by using a special rubber band pulled over the top part of the folded potty.

Thanks to this, the used potty can be transferred to a proper disposal location with an adequate level of hygiene. In addition, this design does not allow for the possible spread of the unpleasant odor.

Previous known potties met their primary requirement which is to collect and store refuse, however, due to their structural limitations and the materials used they were not easy to use on the go, and did not provide leakage protection after being used.

In comparison to the applicants' previous application number P398 090, the present solution includes the following different elements:

1. The potty has more outward edge folds than inward ones.
2. Instead of a cord and or a rubber band circumscribing the potty and threaded through special openings, the potty has two rubber bands placed on opposite walls which facilitate easier opening and better stabilization of the potty, and a rubber band for fastening the potty places on one of the wider walls.
3: The seat of the potty is connected to its walls by gluing the seat to rectangular wings.
4. The potty has additional foil handles.

BRIEF DESCRIPTION OF THE SEVERAL VIEWS OF THE DRAWINGS

The present invention is illustrated in the accompanying drawings, in which.

Figure 1:
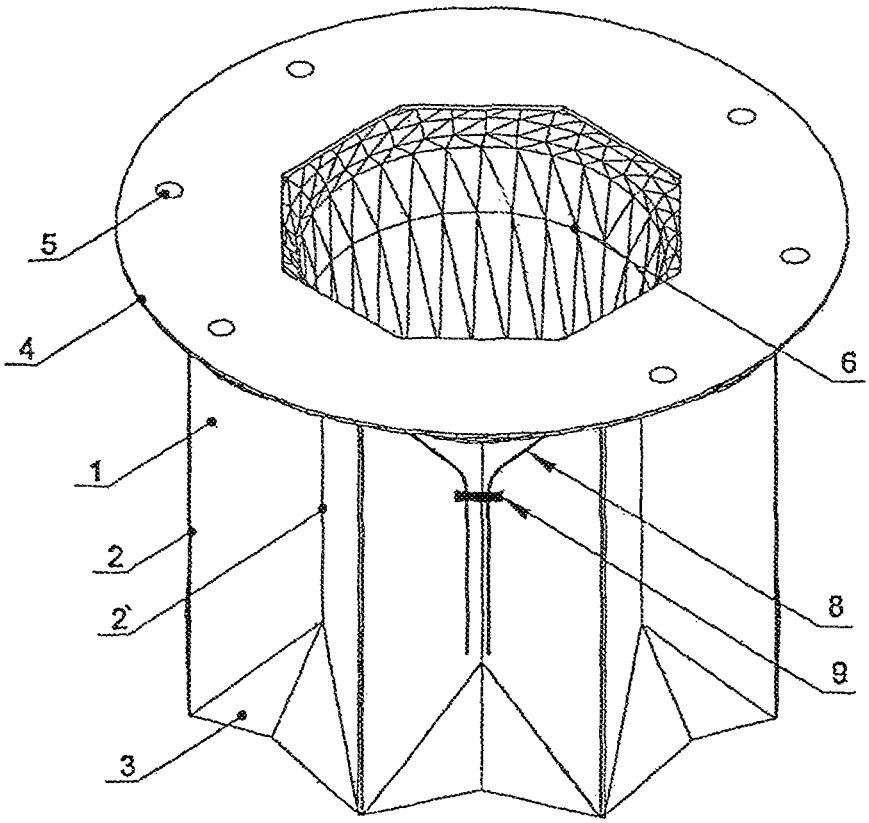
FIG. 1 shows the potty in the unfolded form
Figure 2:
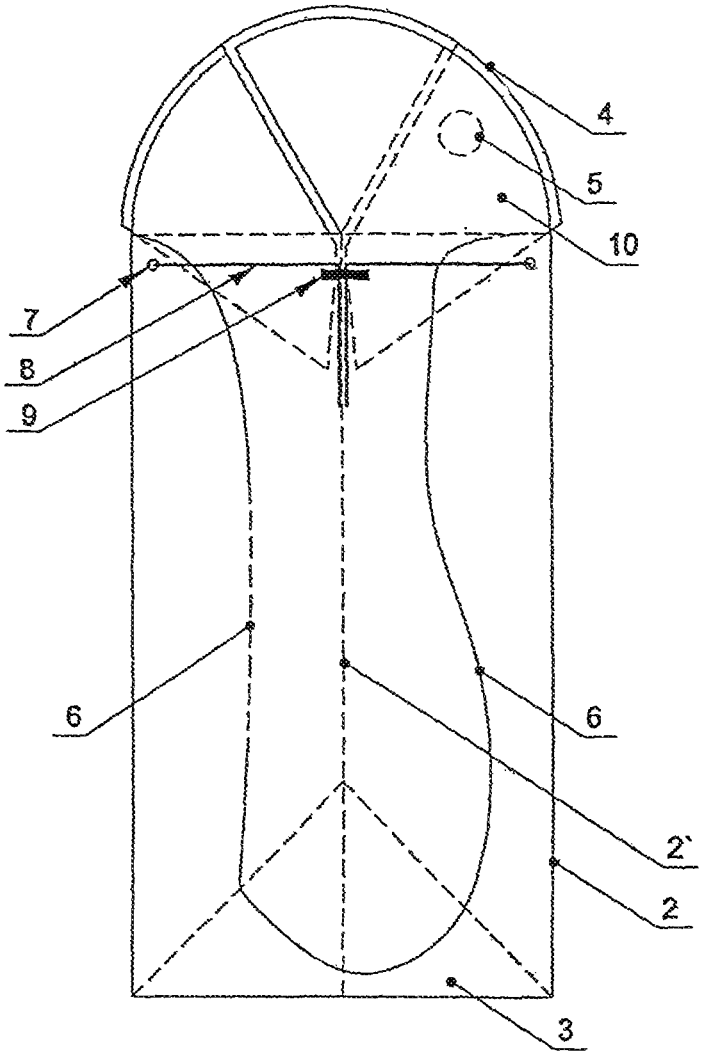
FIG. 2 shows the potty in the folded form
Figure 3:
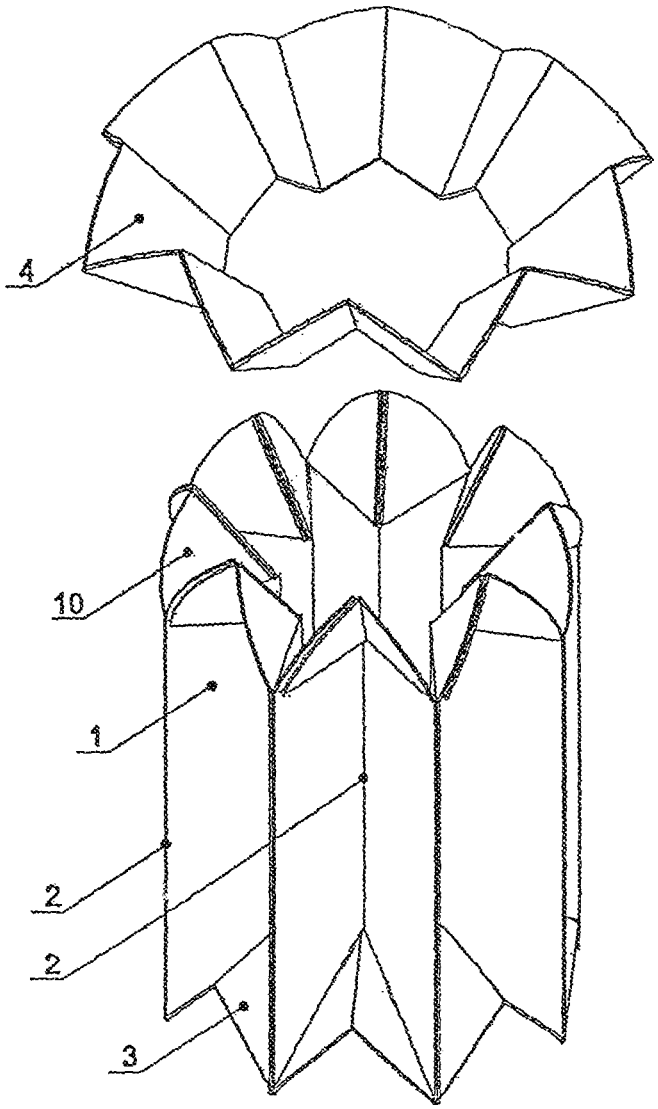
FIG. 3 shows separately the potty walls and the seat wall
Figure 4:
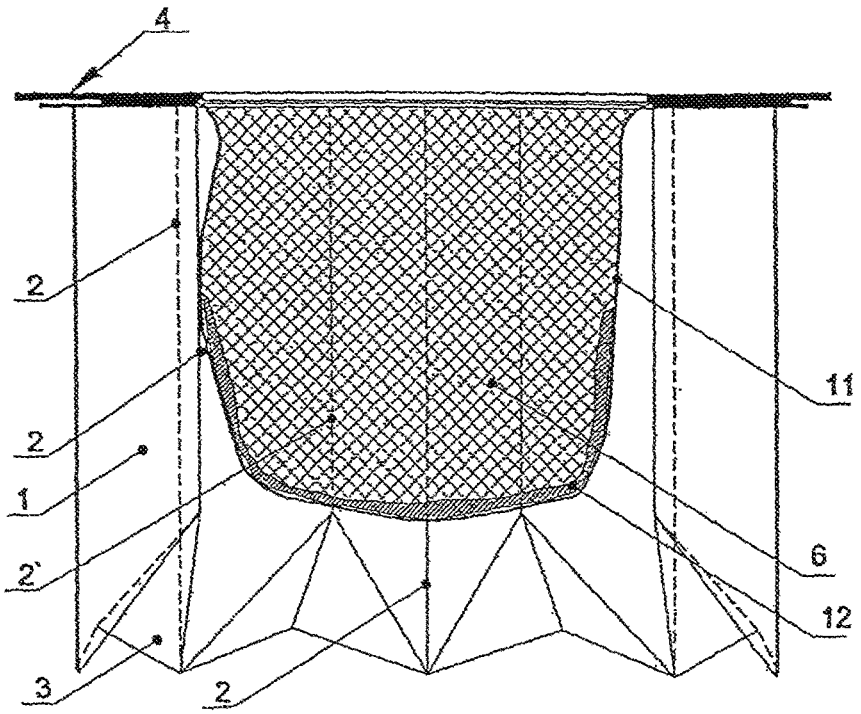
FIG. 4 is the potty's cross-section AA.

Potty is made of a cardboard carton forming the walls of the potty 1, which has vertical folds 2 and 2' to allow for folding it into a flat shape (FIG. 2) and unfolding (FIG. 1). In the example the walls of the potty 1 have eight outside folds 2 and eight folds to the inside of the potty 2'.

Figure 5:
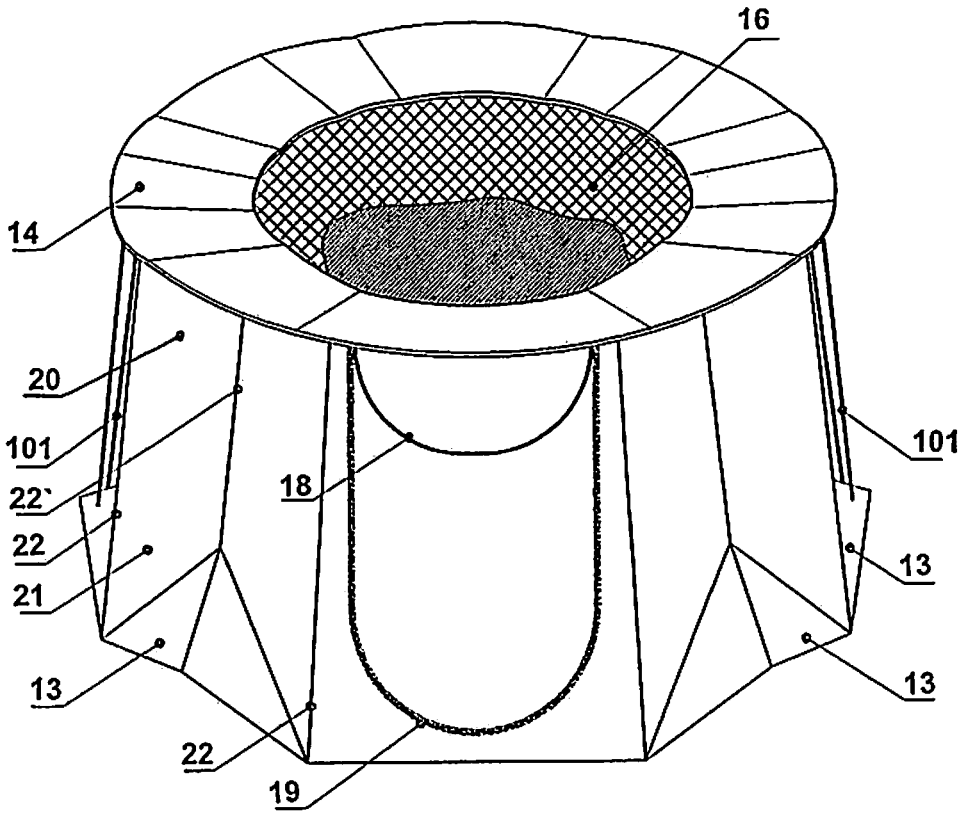
FIG. 5 shows the improved potty in the unfolded form
Figure 6:
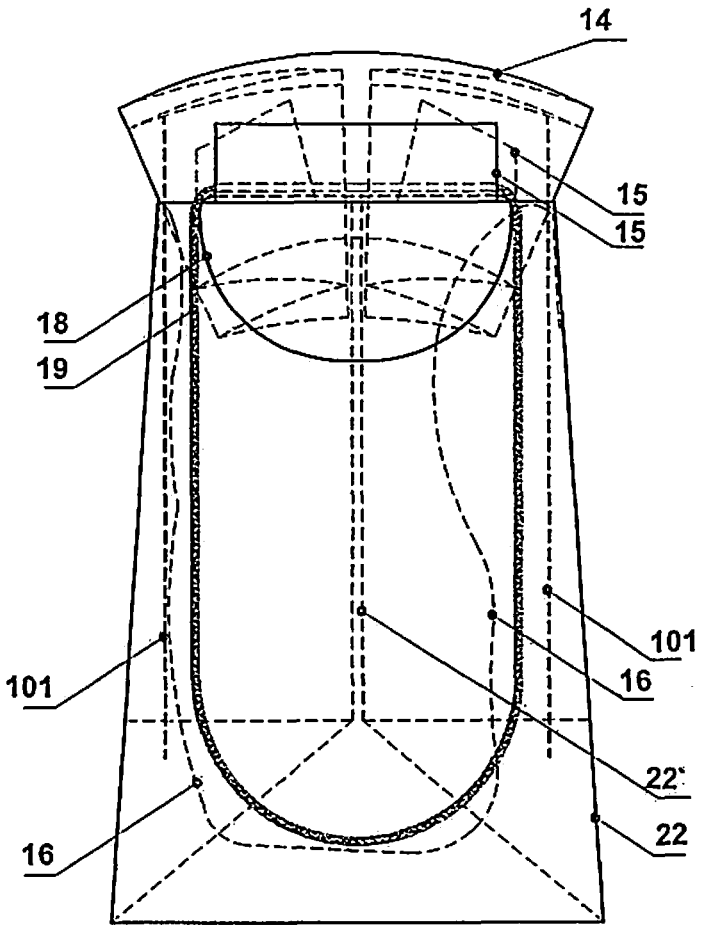
FIG. 6 shows the improved potty in the folded form
Figure 7:
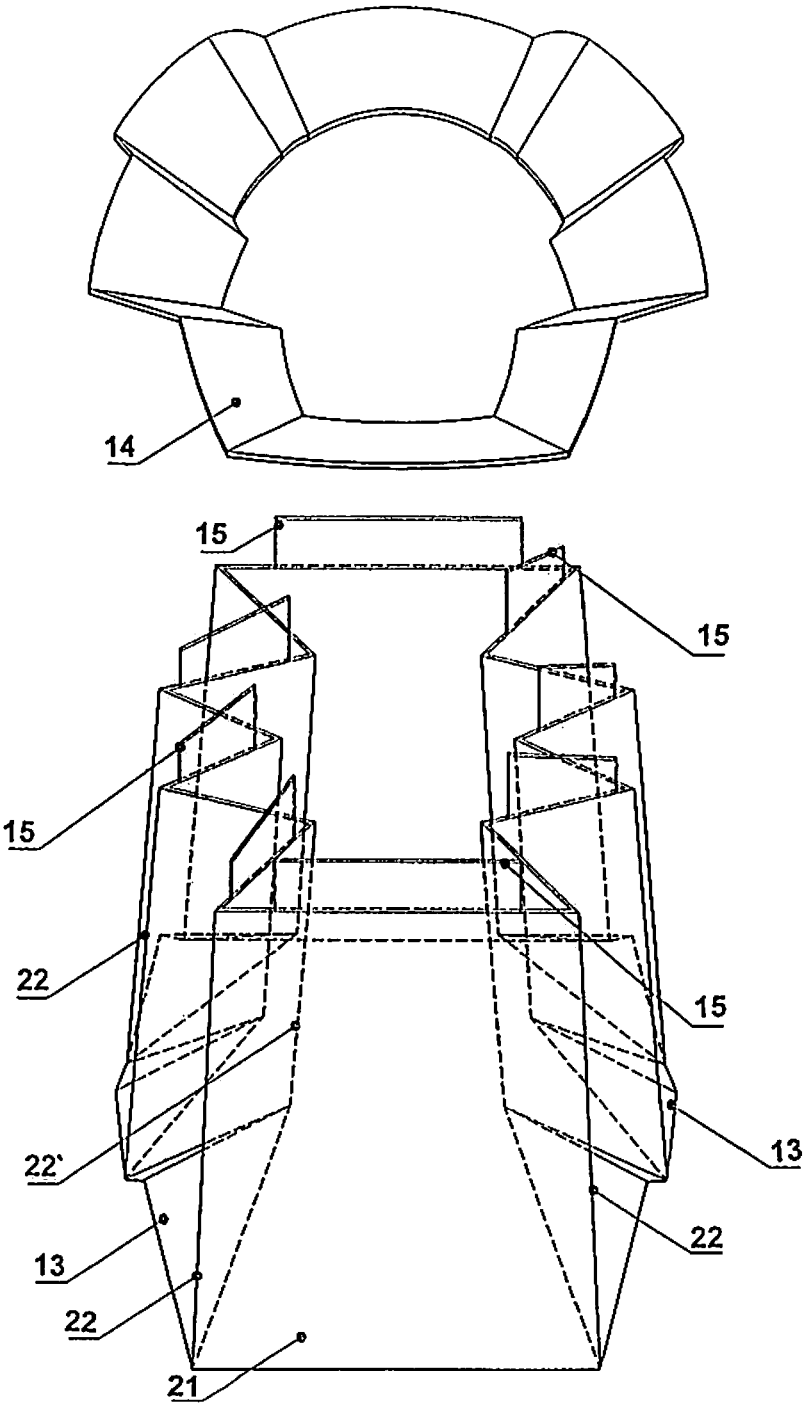
FIG. 7 shows separately the improved potty walls and the seat wall
Figure 8:
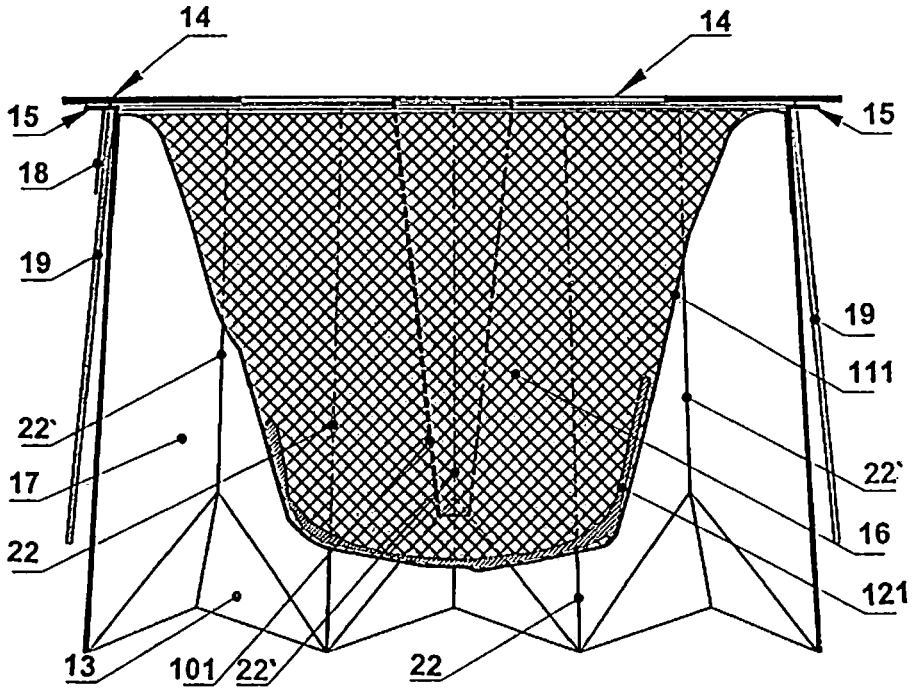
FIG. 8 is the improved potty's cross-section AA.

The improved potty according to the present invention is made of a cardboard carton forming the walls of the potty 20, which has vertical folds 22 and 22' to allow for folding it into a flat shape (FIG. 6) and unfolding (FIG. 5). In the example the walls of the potty 20 have eight outward folds 22 and six inwards folds to the inside of the potty 22'.

It is possible to use a smaller or larger number of folds, but the above layout is the most suitable for the folding and the size of the potty.

It is possible to use a smaller or larger number of folds, but the above layout is the most suitable for the folding and the size of the potty, and the outward folds should outnumber the inward folds by two.

Additionally, at the bottom part of the vertical walls triangular folds were made along the fold lines at an angle of 45 degrees.

The bottom folds 3 make it possible for enough space to be left for the absorbent pad, also with its content, and they stiffen the structure, and further facilitate unfolding with little force applied.

On the walls of the potty 1 there is also a surrounding element made of cardboard, forming the potty seat 4, which is attached to the potty with connectors 5 with the walls of the potty 1.

The connectors 5 are mounted between the triangular wings 10 ending each vertical wall 1 and the seal 4.

For eight modules used in the potty, there are six connections. Two diametrical points do not have connectors in order to allow for the potty to completely fold and unfold in these points when used.

The bottom folds 13 make it possible for enough space to be left for the absorbent pad, also with its content, and they stiffen the structure, and further facilitate unfolding with little force applied.

The upper ends of some of the potty walls are fitted with rectangular wings 15, which are attached with glue to an enclosing element also made of cardboard and forming the seat of the potty 14.

The supporting structure of the potty is made of pasteboard or similar material which folds like cardboard and meets the strength requirements.

The folding method is based on appropriate points folding surfaces, allowing for the structure to be rigid and resistant to weight upon unfolding.

The top folds in the form of triangular wings 10, upon unfolding, form surfaces which are the base for connecting the potty seat 4 and the absorbent pad 6 located between the walls inside the potty seat potty 1 and the seat 4. The absorbent pad is made of two layers connected together.

The top folds in the form of rectangular wings 15, upon unfolding, form surfaces which are the base for connecting the potty seat 14. The absorbent pad 16 is made of two layers connected together.

The first leakproof layer 11 is placed to the outside of the pad, i.e. thin plastic film, and the second layer 12 absorbs the liquid contents of the potty to prevent them from moving around upon folding and during transportation.

The second layer 12 can be in the form of lignin, for example.

The absorbent pad 6 placed inside the walls 1, and its edges are connected in the layer between the walls of the potty 1 and the potty seat 4 with a suitable adhesive or other bonding method that meets the requirements.

The absorbent pad 16 placed inside the walls 21, and its edges are connected to the walls of the potty 20 with a suitable adhesive or other bonding method that meets the requirements.

It is possible to use as a pad 6 made of a different one or multi-layer material, with sufficient endurance that meets the criteria for use.

Moreover, in the upper part of the walls of the potty 1 there are openings 7, through which the cord 8 is threaded, which is used for closing the potty after use. On the cord there is the closing element (puller) in the form of a plastic element 9, which holds the taut cord 8 when pulled winding rubber bands 10 have been mounted to the seat 4. The rubber bands are hooked on a notch made in the cardboard fold 3 and notches in the seat 4 to help open and stabilize the potty.

Furthermore, winding rubber bands 101 have been mounted to the seat 14. The rubber bands are hooked on a notch made in the cardboard fold 13 and notches in the seat 14 to help open and stabilize the potty.

After releasing the puller mounted on the cord, the potty partially folds due to the many bends in the paper, which helps to further unfold the potty.

Upon release, the puller 9 is moved to the end of the cord 8, which does not prevent the potty from folding. After use, pulling tight on the puller 9 mounted on the cord 8 back to the initial position will fold the potty, while leaving the possibility of the walls 1 diverging in the bottom part thanks to the accordion system of folds making it possible to fit the absorbent pad 6 when its content is larger.

Instead of the cord 8, an elastic rubber band can be used.

Additionally, the potty is equipped with two foil handles 19 used for transport of the potty after use. In the place where one of the handles 19 is located, there is a rubber band 18 which is used to close the potty after use in such a way, that the upper part of the potty in the folded position (FIG. 6) is wrapped around with the rubber band 18.

The invention claimed is:

1. A disposable folding potty made of a sheet layer material, characterized in that the potty consists of: walls (1), connected by side edges (2, 2') defining an inner space of the potty (4) in the form of an accordion and having folds in a bottom part (3), and the walls (1) are connected to a potty seat (4) by spot connectors (5), and the potty seat (4) is connected to the walls (1) with the spot connectors (5) mounted between triangular flaps (10) ending each vertical wall (1) and the potty seat (4), except for one pair of opposite walls, and between the potty seat (4) and the walls (1) are fitted with a bag with absorbent material (6).

2. The potty according to claim 1, characterized in that the walls (1) of the potty have advantageously eight folds to an outside (2) and eight folds to an inside (2') forming an accordion pattern.

3. The potty according to claim 1, characterized in that the potty has openings (7) in the walls (1) used to thread a cord (8) for closing the absorbent material (6) and a fastener.

4. A disposable folding potty comprising
- walls (1) made of a sheet layer material;
- side edges (2, 2') connecting the walls (1);
- defining an inner space of the potty in the form of an accordion;
- a bottom part (3);
- folds disposed in the bottom part (3);
- a potty seat (4);
- triangular flaps;
- spot connectors (5) connecting the walls (1) to the potty seat (4), and
- a seat surface (4) is
- connected to the walls (1) with the spot connectors (5) mounted between the triangular flaps (10) ending each vertical wall (1) and the seat (4), except for one pair of opposite walls, and between the seat (4) and the walls (1) is fitted with a bag with absorbent material (6).

5. The potty according to claim 4, characterized in that the walls (1) of the potty have advantageously eight folds to an outside (2) and eight folds to an inside (2') forming an accordion pattern.

* * * * *